US007448208B2

(12) United States Patent
Montineri

(10) Patent No.: US 7,448,208 B2
(45) Date of Patent: Nov. 11, 2008

(54) HYDRAULIC ARRANGEMENT FOR A LIFTING ARM PIVOTABLY MOUNTED ON A VEHICLE

(75) Inventor: Giampaolo Montineri, Corciano (IT)

(73) Assignee: CNH America LLC, New Holland, PA (US)

( * ) Notice: Subject to any disclaimer, the term of this patent is extended or adjusted under 35 U.S.C. 154(b) by 37 days.

(21) Appl. No.: 11/518,781

(22) Filed: Sep. 11, 2006

(65) Prior Publication Data

US 2007/0056278 A1 Mar. 15, 2007

(30) Foreign Application Priority Data

Sep. 15, 2005 (IT) ..... TO2005A0629

(51) Int. Cl.
*F16D 31/02* (2006.01)

(52) U.S. Cl. ..... 60/469

(58) Field of Classification Search ..... 60/413, 60/469

See application file for complete search history.

(56) References Cited

U.S. PATENT DOCUMENTS 3,595,264 A * 7/1971 Martin ..... 91/420
6,370,874 B1 * 4/2002 Rausch et al. ..... 60/413
2005/0072144 A1 * 4/2005 Bitter et al. ..... 60/413

* cited by examiner

*Primary Examiner*—F. Daniel Lopez
(74) *Attorney, Agent, or Firm*—Patrick M. Sheldrake; John William Stader; Michael G. Harms

(57) ABSTRACT

A hydraulic arrangement is described comprising a lifting cylinder 10 for a lifting arm 12 pivotably mounted on a vehicle. A hose 22 selectively connects a working chamber 10*a* of the lifting cylinder 10 to a supply 16 and a return 18 line to raise and lower the lifting arm, respectively. A safety check valve 46 is connected between the hose 22 and the working chamber 10*a* to maintain the working chamber under pressure and avoid collapse of the lifting arm 12 in the event of rupturing of the hose 22. An accumulator 70 is connectable to the working chamber 10 of the lifting cylinder 10 by way of the safety check valve 46 to provide ride control. A solenoid 50 overrides the operation of the safety check valve 46 while the hose 22 is isolated from both the supply 16 and the return 18 line to allow fluid to flow in both directions between the accumulator 70 and the working chamber 10*a* to cause the lifting cylinder to act as a spring supporting the weight of the lifting arm. A pressure switch 82 prevents overriding of the operation of the safety check valve 46 if the pressure in the hose 22 should drop below a threshold.

5 Claims, 1 Drawing Sheet

HYDRAULIC ARRANGEMENT FOR A LIFTING ARM PIVOTABLY MOUNTED ON A VEHICLE

FIELD OF THE INVENTION

The present invention relates to a hydraulic arrangement for raising and lowering a lifting arm pivotably mounted on a vehicle. The invention has particular application to, and will be described with reference to, so-called telehandlers in which a telescopic boom arm is pivotably mounted at one end on the rear of the vehicle. It should however be understood that the invention is not restricted to telehandlers but can also be used in mobile cranes or f or a lifting arm or a rear hitch of a tractor.

BACKGROUND OF THE INVENTION

In telehandlers, the free end of the telescopic boom arm can be used to mount a variety of lifting implements (forks, shovels, hoists etc.). The boom arm is raised and lowered by means of a hydraulic cylinder and it can also be extended and retracted. The lifting cylinder needs itself to be connected pivotably to the vehicle body and to the boom arm, which makes the use of flexible hydraulic high pressure hoses inevitable. To safeguard against rupturing of the supply hose, it is normal to provide a safety check valve which prevents fluid from escaping from the hydraulic cylinder, and therefore collapse of the boom arm, if the high pressure supply hose should burst.

If the vehicle is driven on a road or over rough ground while carrying a load, the inability of the boom arm to move relative to the vehicle body creates a tendency for the chassis to oscillate and interferes with the handling and control of the vehicle.

U.S. Pat. No. 4,658,970, US 2005/0072144 and EP 1157973 all propose a "ride control" mode of operation, in which the lifting cylinder is connected to a hydraulic accumulator so that it acts as a spring. This allows sprung pivotal movement of the boom arm and thereby improves the drivability of the vehicle.

In US 2005/0072144, there is no safety check valve and rupturing of the supply hose to the lifting cylinder would result in an unsafe collapse of the book arm.

In EP 1157963 the accumulator is connected between the safety check valve and the working chamber of the lifting cylinder. This means that the line connecting the accumulator to the cylinder bypasses the safety check valve and if that line should rupture while the ride control is effective, the boom arm would be unsupported. If one instead connects the accumulator to the working chamber of the lifting cylinder through the check valve, as taught by U.S. Pat. No. 4,658,970, the operation of the check valve has to be overridden while the ride control is effective and, in this case, a rupture in either of the hoses connected to the lifting cylinder could cause the boom arm to collapse.

OBJECT OF THE INVENTION

The present invention seeks therefore to provide a hydraulic arrangement for raising and lowering a lifting arm pivotably mounted on a vehicle that will avoid collapse of the lifting arm in the event of a burst hose, both while the ride control is effective and while it is disabled.

SUMMARY OF THE INVENTION

According to the present invention, there is provided a hydraulic arrangement comprising a lifting cylinder for a lifting arm pivotably mounted on a vehicle, a hose for selectively connecting a working chamber of the lifting cylinder to a supply and a return line to raise and lower the lifting arm, respectively, a safety check valve connected between the hose and the working chamber to maintain the working chamber under pressure and avoid collapse of the lifting arm in the event of rupturing of the hose, an accumulator connected to the working chamber of the lifting cylinder by way of the safety check valve, and means for overriding the operation of the safety check valve while the hose is isolated from both the supply and the return line and allowing fluid to flow in both directions between the accumulator and the working chamber to cause the lifting cylinder to act as a spring supporting the weight of the lifting arm, wherein means are provided for monitoring the pressure in the connection between the accumulator and the lifting cylinder and preventing the overriding of the operation of the safety check valve when the monitored pressured drops below a threshold.

While it would be possible to implement the invention using a single acting cylinder, it is preferred for the lifting cylinder to be a double acting cylinder with two working chambers having piston faces of different size, the two working chambers being connected to one another when connected to the accumulator in the ride control mode.

In such a construction, supply and return hoses are advantageously connected to the two working chambers each by way of a respective overridable safety check valve.

When using a double acting cylinder with safety check valves on both working chambers, it is necessary to open the safety check valve connected to the hose leading to the return line. To achieve this, the two safety check valves may be suitably interconnected by pilot lines such that when one of the hoses is connected to the pressurised supply line, the check valve connected to the other hose is opened.

Either or both safety check valves may be overridable electrically by actuation of a respective solenoid. The overriding can either be effected by raising the valve closure element of the check valve off its seat or by opening a passage connected in parallel with the check valve.

In the preferred embodiment of the invention, the means for preventing the overriding of the operation of the safety check valve is a pressure sensitive switch arranged to inhibit the supply of current to the solenoid of each overridable safety check valve.

It is further preferred to provide an electrically operated accumulator valve to connect the accumulator to each working chamber of the lifting cylinder, the accumulator valve being connected in the same electrical circuit as the solenoid of each safety check valve whereby the operation of each safety check valve can only be overridden when the accumulator is connected to the or each working chamber.

BRIEF DESCRIPTION OF THE DRAWINGS

The invention will now be described further, by way of example, with reference to the accompanying drawing labelled FIG. 1, which is a schematic diagram of a hydraulic arrangement of the present invention.

DETAILED DESCRIPTION OF THE PREFERRED EMBODIMENT

Figure 1:
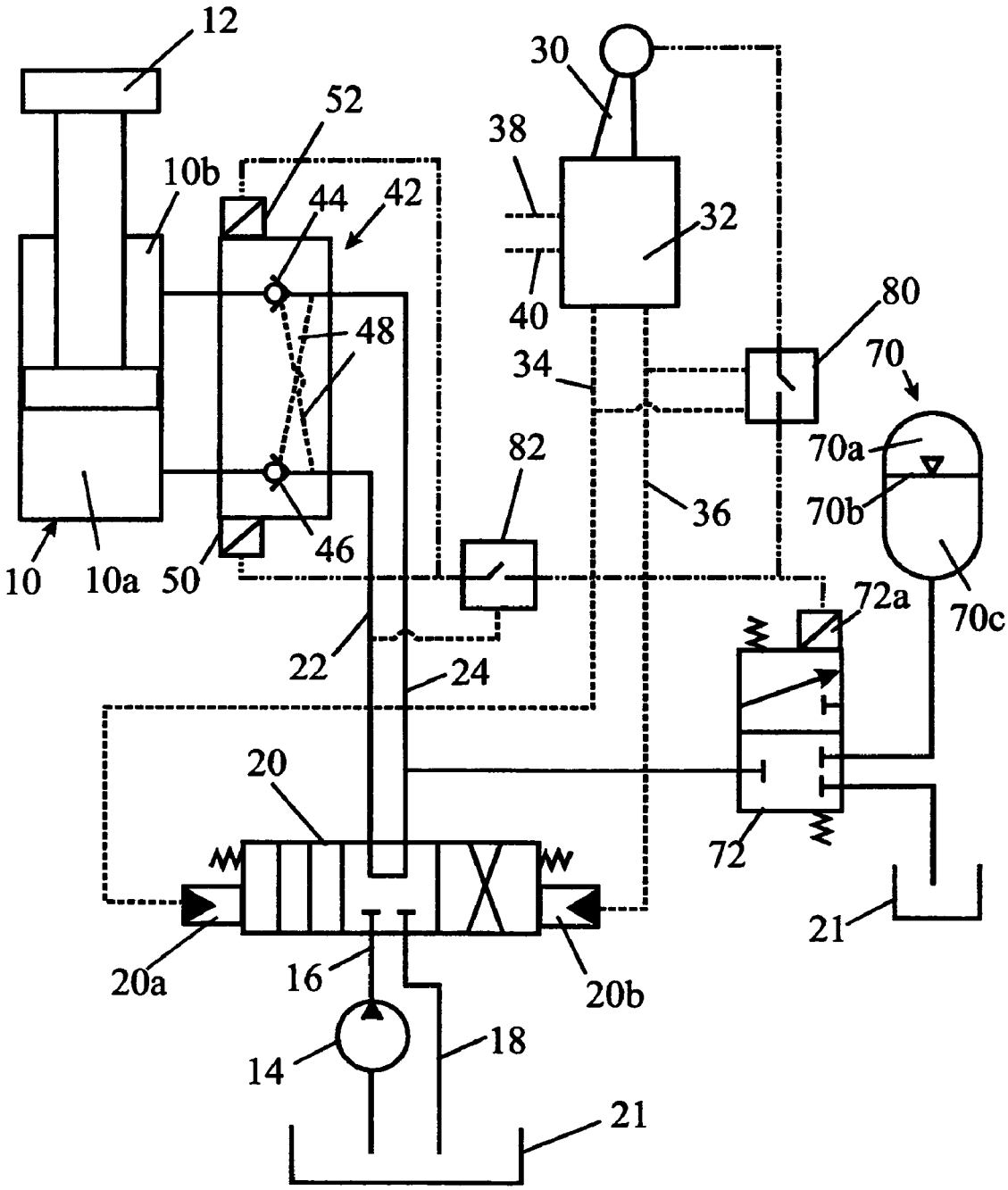

The accompanying drawing shows a double acting lifting cylinder 10 connected to a boom arm 12 of a telehandler. The illustrated hydraulic arrangement is concerned only with the raising and lowering of the boom arm 12, not with its extension and retraction which are controlled separately.

To assist in understanding the diagram, hoses and connections conveying hydraulic fluid under high pressure to raise and lower the boom arm 12 are shown in solid lines. Hydraulic control lines serving to control the operation of valves are shown in dotted lines and electrical control lines are shown in chain dotted lines.

A pump 14 pressurises a supply line 16 while a return line 18 leads back to a reservoir 21. The supply and return lines 16 and 18 are connected to the working chambers 10*a* and 10*b* of the lifting cylinder 10 by an UP/HOLD/DOWN spool valve 20 and two flexible hoses 22 and 24. The spool valve 20 is biased into the illustrated central position in which the hoses 22 and 24 are connected to one another but isolated from the supply and return lines, this being the HOLD position. The other two positions of the valve 20 are for raising and lowering the boom arm 12. The spool is moved into the UP and DOWN positions by the action of a joystick 30 which itself operates a valve 32 to supply hydraulic fluid from a separate supply and return lines 38 and 40 to control chambers 20*a* and 20*b* of the valve 20, by way of hydraulic control lines 34 and 36. Hydraulic fluid supplied by the valve 32 to the control line 34 moves the spool to the right, as viewed, to raise the lifting cylinder and conversely pressure in the control line 36 moves the spool of the valve 20 to the left to lower the lifting cylinder 10.

The hoses 22 and 24 are connected to the working chamber by way of a connection block 42 that is mounted directly on and forms part of the lifting cylinder 10. The connection block houses two safety check valves 44 and 46 each arranged between a respective one of the working chamber 10*a* and 10*b* and a respective one of the flexible hoses 22 and 24. These valves 44 and 46 can be opened by pressure in two pilot lines 48 so that high pressure in either of the hoses 22 and 24 will act to keep open the safety check valve connected to the other.

As so far described, the hydraulic arrangement can raise and lower the boom arm 12 or hold it in a fixed position relative to the vehicle. In the event of either of the hoses 22 and 24 rupturing, the safety check valves 44 and 46 prevent any fluid from escaping from either of the working chambers 10*a* and 10*b* of the lifting cylinder 10 so that there is no risk of the boom arm 12 collapsing.

The rigid connection between the boom arm and the vehicle is not desirable when the vehicle is being driven at speed or over rough ground. For this, the illustrated hydraulic arrangement provided a ride control mode of operation in which the boom arm is sprung.

To achieve ride control, a hydraulic accumulator 70 is provided which, as is well known, comprises a gas filled chamber 70*a*, that acts as a gas spring, separated by a flexible diaphragm 70*b* from a chamber 70*c* filled with hydraulic fluid. A two position accumulator valve 72 operated by a solenoid 72*a* acts to connect the accumulator to both working chambers 10*a* and 10*b* of the lifting cylinder 10 when the valve 20 is in the HOLD position and the two hoses 22 and 24 are connected to one another.

At this time, the operation of the valves 44 and 46 is overridden by means of two solenoids 50 and 52. These solenoids can either act on the closure elements of the check valves 44 and 46 to lift them off their respective valve seats, or they may open and close a passage connected in parallel with the check valves 44 and 46. As a result the two working chambers 10*a* and 10*b* are connected to one another and to the chamber 70*c* of the accumulator 70 for flow in both directions.

Because the working areas of the opposite faces of the piston in the cylinder 10 are of unequal size, downward movement of the boom arm displaced hydraulic fluid into the accumulator chamber 70*c* and conversely hydraulic fluid is drawn from the accumulator chamber 70*c* when the boom arm 12 moves upwards. The weight of the boom arm 12 is thus supported by the accumulator 70 which acts as an air spring to cushion up and down movement of the boom arm in the ride control mode of operation. Damping is provided by the flow of hydraulic fluid in the hoses 22 and 24 and through the various valves connecting the accumulator chamber 70*c* to the working chambers 10*a* and 10*b* of the lifting cylinder 10.

To activate ride control, an electrical switch is operated in the knob of the joy stick 30. This applies a voltage through a first pressure sensitive switch 80 to the solenoid 72*a* of the accumulator valve 72 and by way of a second pressure sensitive switch 82 to the solenoids 50 and 52.

The first switch 80 is opened if pressure is sensed in either of the control lines 34 and 36. The switch 80 acts as a safety interlock which only allows the ride control mode to be activated while the valve 20 is in the HOLD position and prevents its activation while the boom arms are being lowered or raised.

The switch 82 on the other hand is only closed if the pressure in the hoses 22 and 24 is above a safety threshold. In the event that either of the hoses 22 and 24 should rupture while the ride control mode is active, the switch 82 will open and interrupt the current supply to the solenoids 50 and 52 so that the safety check valves 44 and 46 will cease to be overridden and will act to prevent collapse of the boom arm 12.

The invention claimed is:

1. A hydraulic arrangement comprising: double acting lifting cylinder, having first and second working chambers and piston faces of different sizes, for a lifting arm pivotably mounted on a vehicle, a first hose for selectively connecting the first working chamber of the lifting cylinder to a supply line and a return line to raise and lower the lifting arm, a first safety check valve connected between the first hose and the first working chamber, a second hose for selectively connecting the second working chamber to the supply line and the return line, a second safety check valve connected between the second hose and the second working chamber, an accumulator connected to the first working chamber of the lifting cylinder by way of the first safety check valve, and a respective electrically actuated solenoid for overriding the operation of each of the safety check valves while either hose is isolated from both the supply and the return line and allowing fluid to flow in both directions between the accumulator and the working chamber to cause the lifting cylinder to act as a spring supporting the weight of the lifting arm, wherein a pressure sensitive switch, arranged to inhibit the supply of current to the respective of each overridable safety check valve monitors the pressure in the connection between the accumulator and the lifting cylinder and prevents the overriding of the operation of the safety check valve when the monitored pressured drops below a threshold.

2. A hydraulic arrangement as claimed in claim 1, wherein the two safety check valves are interconnected by pilot lines such that when one of the hoses is connected to the pressurized supply line, the check valve connected to the other hose is opened to permit fluid to flow from the other working chamber to the return line.

3. A hydraulic arrangement as claimed in claim 1, wherein an electrically operated accumulator valve is provided to connect the accumulator to a working chamber of the lifting cylinder, which accumulator valve is connected in the same electrical circuit as the solenoid of each safety check valve whereby the operation of each safety check valve can only be overridden when the accumulator is connected to a working chamber.

4. A hydraulic arrangement as claimed in claim 3, wherein an UP/HOLD/DOWN valve is provided to control the connection of the lifting cylinder to the supply and return lines, and wherein a safety interlock is provided to inhibit operation of the accumulator valve when the cylinder is connected to either one of the supply and return lines.

5. A hydraulic arrangement as claimed in claim 4, wherein the UP/HOLD/DOWN valve is a hydraulically operated spool valve having control chambers connected by control lines to a joystick and wherein the interlock comprises a pressure sensitive switch connected to the control lines.

* * * * *